United States Patent [19]

Kulesza et al.

[11] Patent Number: 4,566,195

[45] Date of Patent: Jan. 28, 1986

[54] MAGNETIC DRAWING TOY

[75] Inventors: Ralph J. Kulesza, Chicago; Walter J. Wozniak, Addison; Harry Disko, South Barrington; Burton C. Meyer, Downers Grove, all of Ill.

[73] Assignee: Marvin Glass & Associates, Chicago, Ill.

[21] Appl. No.: 692,122

[22] Filed: Jan. 17, 1985

[51] Int. Cl.[4] ..... B43L 13/00

[52] U.S. Cl. ..... 33/27.11; 446/136

[58] Field of Search ..... 33/18 R, 27 L, 27 R; 446/134, 135, 136

[56] References Cited

U.S. PATENT DOCUMENTS

| | | | |
|---|---|---|---|
| 3,510,949 | 5/1970 | Christy | 33/27 L |
| 4,099,330 | 7/1978 | Hicks et al. | 33/18 R |
| 4,369,579 | 1/1983 | Mizoule | 33/27 L X |

*Primary Examiner*—Harry N. Haroian

*Attorney, Agent, or Firm*—John S. Pacocha

[57] ABSTRACT

A drawing toy including a housing providing a raised support for a generally flat platen. Within the housing is a battery powered motor with the motor shaft extending up through the platen. The motor rotates a magnet beneath the platen. Magnetically coupled templets, fitting over or abutting the shaft, are driven around the shaft. Various drawing implements may be inserted into the templet openings for producing geometric art patterns on nonmagnetic media positioned between the platen and the templet.

9 Claims, 8 Drawing Figures

MAGNETIC DRAWING TOY

BACKGROUND OF THE INVENTION

1. Field of the Invention

This invention relates generally to design drawing toys and more particularly to magnetically driven design drawing toys.

2. Background Art

Toys facilitating the creation of pleasing designs or patterns by children are both entertaining and educational playthings. In prior art design drawing toys, templets that are manually movable about the inner periphery of a window opening, as disclosed in U.S. Pat. Nos. 3,465,445 and 3,535,791 and which have engagable peripheral gear teeth as in U.S. Pat Nos. 3,699,660 and 4,441,256 have been used. A motor driven design drawing toy employing a plurality of gear driven quadrupole magnets mounted at different radial distances from the motor drive shaft to magnetically drive a selectively positioned drawing implement with a quadrupole magnet is disclosed in U.S. Pat. No. 3,510,949. There remains, however, a need for a motor driven design drawing toy that provides the magic of a magnetically coupled drive as well as the economy, flexibility and variety of the templet drawing toys.

SUMMARY OF THE INVENTION

The present invention is concerned with providing a magnetically driven design drawing toy that utilizes templets to create a variety of geometric design patterns. These and other objects and advantages of the invention are achieved by providing a design drawing toy with a housing that supports a raised, substantially flat, platen and encloses a battery powered motor. The shaft of the motor extends up through the platen while rotating a magnet beneath the platen. Magnetically coupled templets fit over or abut the shaft and are driven around the shaft. Drawing implements are insertable into a holder that fits into apertures provided in the templet for producing a large variety of geometric art patterns or nonmagnetic media positioned between the platen and the templet.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
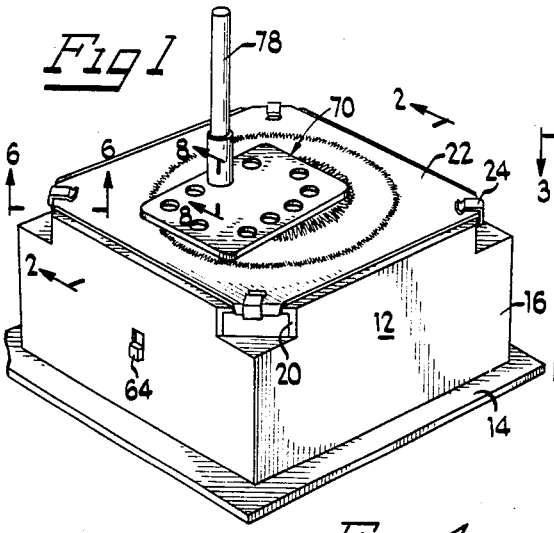
FIG. 1 is a perspective view of an embodiment of the present invention.

Referring now to the drawing in which like parts are designed by like reference numerals throughout the several views, there is shown in FIG. 1 a design drawing toy 10 which includes a housing 12. Although shown in the illustrated embodiment as generally rectangular, housing 12 may be cylindrical or of any desired shape that provides a stable base 14 with upstanding sidewalls 16 supporting a substantially planar platen 18 with an underlying hollow enclosure. Housing 12 may be made of plastic or any other nonmagnetic material. Corner notches 20 provide access to the underside of platen 18 so that a piece of paper 22, or another nonmagnetic media, may be attached on top of the platen by means of C-shaped clips 24.

Generally centrally disposed in the platen 18 is an aperture 26 with a bushing 28. Disposed below the platen within the hollow enclosure of the housing 12 are depending posts 30 and column 32. Attached to the posts 30 is a shelf 34 which has an integrally formed well 36 for mounting motor 40 with motor shaft 42 projecting upwardly. Secured for rotation with the motor shaft 42 is a serrated drive member 44. Adjustably supported on the shelf 34 is a bearing member 46 that rotatably mounts a magnetic shaft 50 with its axis substantially transverse to the plane of the platen. Mounted on shaft 50 for rotation with the shaft below the platen are a speed reducing drive disc 52 with an O-ring 54 that engages the motor drive member 44 to rotate the shaft. Also mounted on shaft 50 below the platen for rotation with the shaft is a permanent magnet 56.

Depending from the column 32 is a battery clip 58 which holds a battery 60. An on/off switch 62 is mounted on a sidewall 16 with the control button 64 accessible through the sidewall. Battery 60 is connected through the switch 62 by conventional wiring (not shown) to the motor 40.

Figure 2:
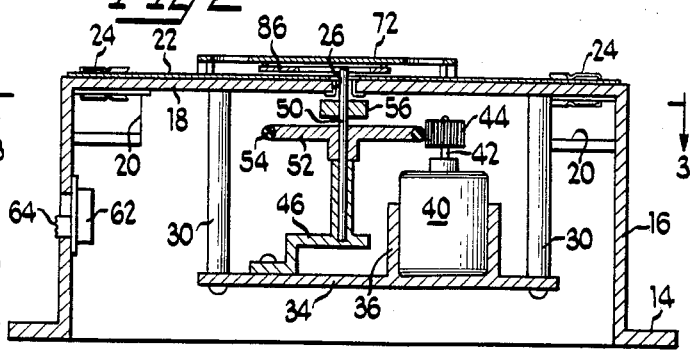
FIG. 2 is an enlarged scale sectional view taken generally along the line 2—2 of FIG. 1.
Figure 4:
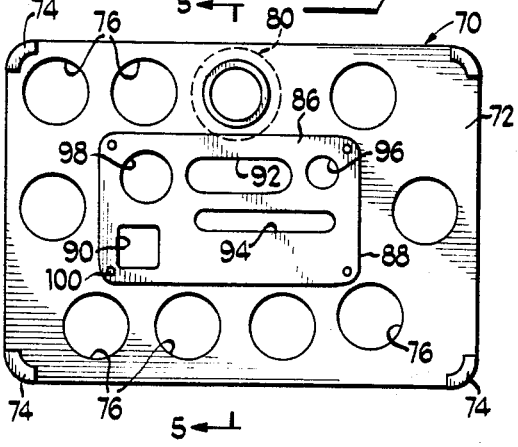
FIG. 4 is an enlarged scale bottom plan view of the templet shown in FIG. 1.
Figure 3:
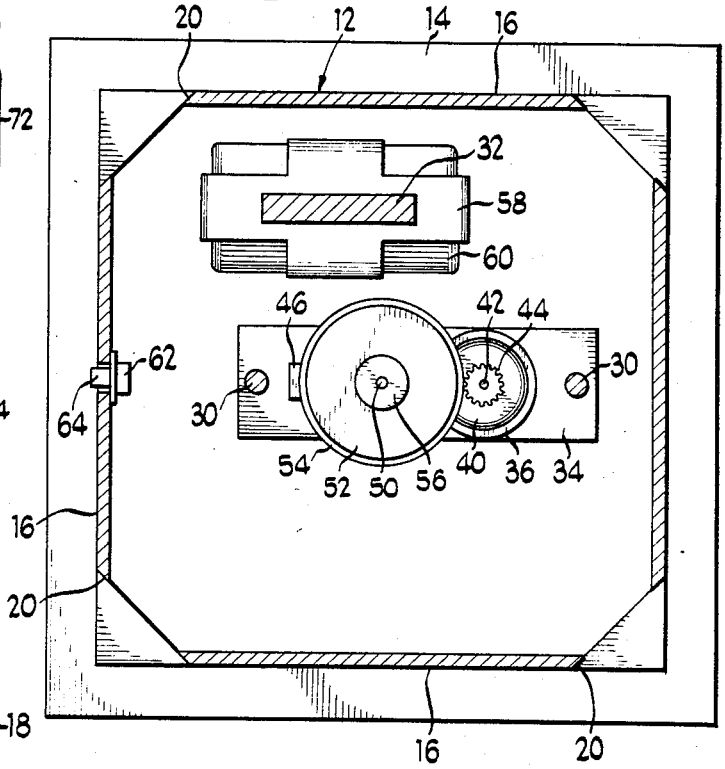
FIG. 3 is a sectional view taken generally along the line 3—3 of FIG. 2.
Figure 5:
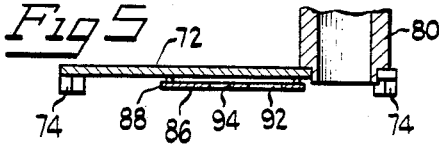
FIG. 5 is a sectional view taken generally along the line 5—5 of FIG. 4.
Figure 6:
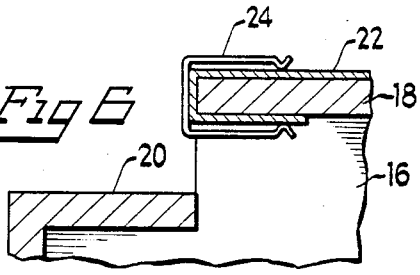
FIG. 6 is an enlarged scale, fragmentary, sectional view taken generally along the line 6—6 of FIG. 1.
Figure 7:
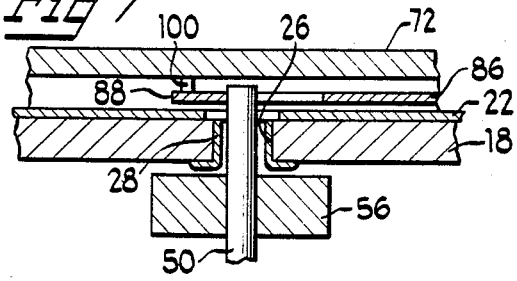
FIG. 7 is an enlarged scale, fragmentary, sectional view of the upper center taken generally along a line transverse to the line 2—2 of FIG. 1.
Figure 8:
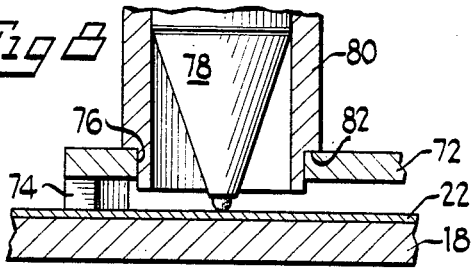
FIG. 8 is an enlarged scale, fragmentary, sectional view taken generally along the line 8—8 of FIG. 1.

As is shown in FIGS. 2 and 7 a portion of the shaft 50 projects upwardly above the top of the platen 18 through the bushing 28. When the paper 22 is placed on top of the platen, the projecting portion of the shaft pierces the paper or the paper may be prepunched. If a stronger nonmagnetic media is used an aperture will have to be provided to accommodate the upwardly projecting portion of the shaft.

A template 70, illustrated as being generally rectangular but which may be of any desired shape, has a main body 72 of a nonmagnetic material such as plastic. Depending from the generally planar upper surface of the body are depending legs 74 which space the main body from the underlying paper. Spaced generally around the periphery of the top of the templet are a plurality of the same size circular apertures 76. In order to support a pen, pencil or other drawing implement 78, a generally cylindrical holder 80 is provided with a chamfered end 82 so that it is supportable in a generally transverse orientation to the platen when inserted into any one of the apertures 76 on the templet.

Secured under plastic body 72 is an plate 86 made of magnetic material such as steel. Plate 86 has an outer periphery 88 and is provided with a number of openings defining different inner peripheries such as a rounded corner square opening 90, a pair of oblong openings 92 and 94 of different sizes plus a pair of circular openings 96 and 98 of different sizes. Bosses or mounting pins 100 space the plate sufficiently from the underside of the main body to accommodate the upper part of shaft 50 extending beyond the outer periphery of the plate or through one of openings 90–98.

To use the drawing toy, a piece of paper 22 is placed over the top of the platen 18 and secured by C-shaped clips 24. Templet 70 is placed on top of the paper with either the outer peripheral edge 88 of plate 86 abutting the projecting portion of shaft 50 or alternatively with the projecting portion of the shaft in one of the openings 90–98. The attraction between magnet 56 disposed underneath the platen and the magnetic plate on the underside of templet 70 rotates the templet while magnetized shaft 50 retains the selected periphery of the plate bearing against the shaft. Thus, templet 70 carrying a drawing implement 78 positioned in one of the apertures 76 is driven by magnet 56 around the pivot point of the projecting end of shaft 50 to create a geometric pattern.

After an initial pattern is drawn a different implement 78 may be used and/or holder 80 may be repositioned in a different aperture and/or the templet may be repositioned with a different periphery of the plate fitting over or abutting the projecting end of the shaft to superimpose other patterns to create a design. The combinations of selected implement holding apertures and plate peripheries provide for a large number of different patterns. Templets of different shapes or with differently arranged apertures and/or plates may be provided to create additional designs using the same basic magnetically driven drawing toy. As part of a complete set, further templets bearing specific designs (not shown) may be provided for then hand drawing a figure such as a butterfly over a geometrically created flower design.

While a particular embodiment of the present invention has been shown and described with some changes and modifications, further changes and modifications will occur to those skilled in the art. It is intended in the appended claims to cover all such changes and modifications as fall within the true spirit and scope of the present invention.

What is claimed as new and desired to be secured by Letters Patent is:

1. A design drawing toy comprising:

a housing;

a substantially flat platen supported atop the housing;

a motor positioned within the housing below the platen;

a rotating magnetizable shaft, the axis of which is substantially transverse to the plane of the platen, projecting up through the platen;

a magnet mounted for rotation with the shaft below the platen; and a removable templet with at least a portion being magnetic and defining a periphery positionable over the platen with the periphery abutting the shaft.

2. The design drawing toy of claim 1 in which the templet is provided with a number of apertures of the same size positioned about the templet at varying distances from the center of the templet.

3. The design drawing toy of claim 2 including a drawing implement holder selectively positionable in any one of the apertures.

4. The design drawing toy of claim 1 in which the magnetic portion includes both internal and external defined peripheries.

5. The design drawing toy of claim 4 in which the peripheries are of different shapes and sizes.

6. The design drawing toy of claim 1 including clip means for retaining paper atop the platen.

7. The design drawing toy of claim 1 in which the templet has a body and the magnetic portion is a plate mounted on the underside of the body.

8. The design drawing toy of claim 7 in which the plate is spaced from the underside of the body.

9. The design drawing toy of claim 7 in which the plate is spaced from the platen.

* * * * *

UNITED STATES PATENT AND TRADEMARK OFFICE

CERTIFICATE OF CORRECTION

PATENT NO. : 4,566,195

DATED : January 28, 1986

INVENTOR(S) : Ralph J. Kulesza, Walter J. Wozniak, Harry Disko, and Burton C. Meyer It is certified that error appears in the above-identified patent and that said Letters Patent is hereby corrected as shown below:

Column 1, Summary of the Invention, line 44, change "or" to --on--.

Signed and Sealed this

First Day of March, 1988

*Attest:*

DONALD J. QUIGG

*Attesting Officer*

*Commissioner of Patents and Trademarks*